US006709323B2

(12) United States Patent
Keller

(10) Patent No.: US 6,709,323 B2
(45) Date of Patent: Mar. 23, 2004

(54) HOLDER FOR FLAT WORKPIECES, PARTICULARLY SEMICONDUCTOR WAFERS

(75) Inventor: Thomas Keller, Osterronfeld (DE)

(73) Assignee: Peter Wolters CMP-Systeme GmbH & Co. KT, Rendsburg (DE)

( * ) Notice: Subject to any disclaimer, the term of this patent is extended or adjusted under 35 U.S.C. 154(b) by 0 days.

(21) Appl. No.: 10/016,920

(22) Filed: Dec. 13, 2001

(65) Prior Publication Data

US 2002/0074478 A1 Jun. 20, 2002

(30) Foreign Application Priority Data

Dec. 14, 2000 (DE) ..... 100 62 497

(51) Int. Cl.[7] ..... B24B 47/02
(52) U.S. Cl. ..... 451/398; 451/288
(58) Field of Search ..... 451/388, 397, 451/398, 287, 288, 289

(56) References Cited

U.S. PATENT DOCUMENTS 6,093,091 A * 7/2000 Keller ..... 451/388
6,132,298 A * 10/2000 Zuniga et al. ..... 451/288
6,447,379 B1 * 9/2002 Gromko et al. ..... 451/287

FOREIGN PATENT DOCUMENTS

DE 195 44 328 5/1996
DE 197 55 975 6/1999

* cited by examiner

*Primary Examiner*—Dung Van Nguyen
(74) *Attorney, Agent, or Firm*—Vidas, Arrett & Steinkraus, P.A.

(57) ABSTRACT

A holder for flat workpieces, particularly semiconductor wafers, particularly in an apparatus for chemico-mechanically polishing the semiconductor wafers, comprising a disk-like head which is adapted to be connected to a spindle adjustable in height at the upper surface and has a support plate at the lower side which, via a universal joint, is coupled to a carrier portion disposed above the support plate or the spindle and which has a number of vertical bores which extend to the underside of the support plate and can be optionally connected to a vacuum and/or a fluid source under pressure, where the support plate is guided to be movable in height in the carrier portion and displacing means are provided between the carrier portion and the support plate to displace the support plate with respect to the carrier portion and to exert a predetermined pressure on the workpiece, characterized in that a ring-shaped loading member of limited width is provided which is movably supported in an axially parallel way in the support plate near its border and is displaceable by a loading mechanism towards a workpiece retained by the support plate and is displaceable away therefrom to apply a predetermined pressure to the workpiece.

6 Claims, 4 Drawing Sheets

HOLDER FOR FLAT WORKPIECES, PARTICULARLY SEMICONDUCTOR WAFERS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a holder for flat workpieces, particularly semiconductor wafers.

The miniaturization of semiconductor components which has steadily intensified over the recent years causes more stringent and new demands to the manufacturing process of the electronic components. Thus, the surface of the semiconductor material to be exposed during the lithographic printing process has to be very flat (the difference in profile being less than 0.4 $\mu$m) if the structure sizes are less then 0.5 $\mu$m in order to lie within the focussing plane. To this effect, the material requires to be planarized by means of suitable devices.

A process serving the purpose is the chemico-mechanical polishing method (briefly called CMP). In this process which uses a polishing agent which is both corrosive and abrasive, the wafer is polished on a polishing cloth in plastic at a defined contact force under a rotatory motion of the polishing cloth and the wafer. While the polishing process is under way the polishing agent (a slurry) will flow onto the polishing cloth and form a film between the cloth and the wafer. The slurry which is used consists of a chemically offensive solution to which particles such as silica are added in a colloidal suspension.

From DE 195 44 328 or the company document "CMP Plaster Tool System Planarization Chemical Mechanical Polishing" published by the Wolters GmbH company in March, 1996, it has been known to provide appropriate stations and devices for such polishing processes. The wafers are retained by holders in processing units and are pressed by them against the polishing working surface. The holders or holding heads are connected to a spindle of a driving machine which is supported to be adjustable in height in order to press the wafer against the working surface. To obtain sufficient planarity, the lower support plate which holds the wafer via vacuum channels or bores is hinged by a universal joint to a carrier portion which, in turn, is connected to the spindle of the driving mechanism. The contact pressure is applied to the support plate via the universal joint.

From DE 197 55 975 A1, it further has become known to guide a support plate for the known holder in a carrier so as to be movable in height and to dispose an annularly closed membrane between the carrier portion and the support plate. The enclosed inner space of the membrane is optionally connected to the atmosphere or a vacuum or a fluid source under pressure. The pressure and vacuum help in displacing the support plate relative to the carrier. In this way, the contact pressure is applied to the support plate on a large surface, which causes an improved result to be obtained in planarization.

Apart from influencing other parameters such as the speed of the wafer, the speed of the polishing disk, the oscillating motions of the polishing head, the supply of polishing agent, and the condition and wear of the polishing cloths, the accuracy and uniformity which can be achieved will have an effect on the result of polishing in the CMP process. Planarized films of 300 mm wafers which are processed by CMP machines frequently present a rotationally symmetric, differentiated surface geometry which is characterized in that the wafer border is heavily polished, the removal of material is least at a small distance from the wafer border, i.e. 3 mm, and the largest removal of material is achieved in a range of abt. 20 mm from the wafer border.

It is the object of the invention to provide a holder for flat workpieces, particularly semiconductor wafers, in which the non-uniformity of the remaining film thickness is reduced.

BRIEF SUMMARY OF THE INVENTION

The inventive holder provides a ring-shaped loading member of limited width which is supported to be movable parallel to the axis in the support plate near the border and is displaceable by a loading device towards a workpiece retained by the support plate and away from the device to exert a predetermined pressure on the workpiece.

The ring-shaped loading member which is brought very close to the border of the support plate, e.g. to a distance of about 3 mm, and which only extends over a limited width, e.g. from 5 to 10 mm, helps in generating a separate extra pressure if a pressure is exerted on the workpiece, particularly the wafer, by means of the support plate. Such a measure allows to equalize the removal of material across the overall area of the workpiece, particularly the wafer, to a larger extent.

According to an aspect of the invention, restoring means are provided which displace the loading member in a direction away from the contact surface of the support plate if the loading mechanism is turned off. This ensures that if the workpiece is received by means of a vacuum in order to make the workpiece bear on the support the loading member does not interfere therewith.

Various possible ways are imaginable to form a loading member and to actuate it. For an actuation, it is preferred that a pneumatic pressure be employed all the more so as it is known and advantageous to produce a contact pressure with the support plate via a fluid pressure. It is particularly advantageous to use a ring-shaped hose which is accommodated in a ring-shaped recess of the support plate. The hose, which is preferably elongate in cross-section, may be expanded by means of a gaseous medium and, thus, can exert a pressure on the workpiece. If the material of the hose yields resiliently the hose may be restored automatically if it is relieved from pressure.

The fluid pressure in the hose-shaped loading member is preferably controlled via a proportional-pressure control valve. This allows to apply a finely proportioned pressure in a purposeful way.

The invention has the advantage that it may be installed in conventional holders. Thus, for example, it is unnecessary to continue employing the retaining ring, which is normally used and which bears against the polishing cloth, in the form which is known.

BRIEF DESCRIPTION OF THE SEVERAL VIEWS OF THE DRAWINGS

An embodiment of the invention will now be explained in more detail with reference to the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
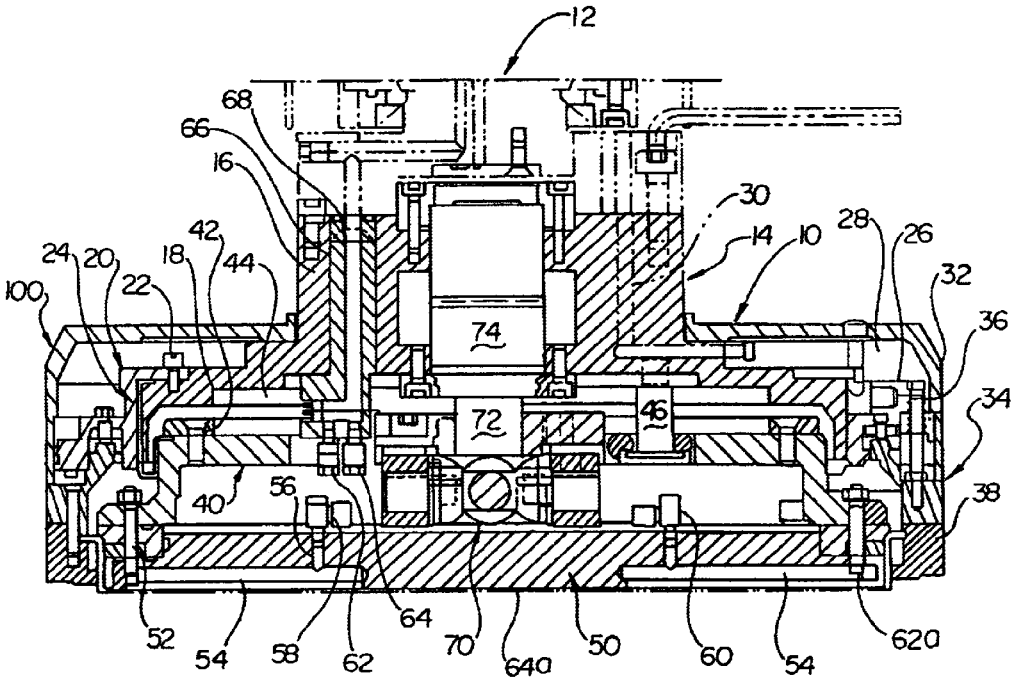
FIG. 1 shows a section through a holder according to the invention.

Referring to FIG. 1, a holder in the form of a retaining head 10 is mounted on a spindle 12 which is only shown in phantom lines. It is mounted by a bolted joint which is not referred to in detail. Mounting is done on a carrier portion 14 of the retaining head 10, which will be described in more detail below. The spindle 12 forms part of a driving mechanism, which is not further shown, of a device for chemico-mechanically polishing the surface of a semiconductor wafer. The spindle 12 not only is rotated, but can also be adjusted in height as is described, for example, in DE 197 55 975 A1 to which explicit reference is made here.

The carrier portion 14 has an axial collar 16 which is joined by an inversely pot-shaped flange 18. A ring-shaped retaining component 20 is fixed to the border of the flange 18 by means of bolts 22. Along with the flange 18, it pinches one end of a ring-shaped rolling membrane 24. The retaining component 20 further has mounted thereon, in a radially more outward position in a ring-shaped recess, a hose 26 which is adapted to be connected to a pressure source, which is not shown, via a flexible line 28 and respective bores 30 in the collar 16 and the spindle 12 to optionally cause the hose 26 to expand or contract. Finally, a retaining ring 34 is suspended from the ring-shaped component 20, i.e. via the bias of a spring 36, by means of pins 32 which are disposed at circumferential spacings. A radially inward portion of the retaining ring 34 bears against the hose 26. The hose 26 may help in axially moving the retaining ring 34 up and down. A ring-shaped sliding portion 38 made of a low-friction non-abrasive material is mounted at the underside of the retaining ring 34.

A bell-shaped portion 40 is coaxially arranged within the inversely pot-shaped flange 18 at an axial distance therefrom. A ring 42 is fixed by a bolted joint to the upper surface of the bell-shaped portion 40. The lower end of the rolling membrane 24 is pinched between the ring 42 and the bell-shaped portion 40. As a result, an enclosed chamber 44 is formed between the carrier portion 14 and the bell-shaped portion 40. This chamber can be optionally connected to a fluid source under pressure or a vacuum source, which is not shown herein. Thus, the fluid may serve for adjusting the bell-shaped portion 40 relative to the carrier portion 14 with adjustment to the bottom being restricted by a pin 46 which is bolted into the flange 18 and has a head which limits the downward motion of the bell-shaped portion 40.

A support plate 50 is bolted to the bell-shaped portion 40 at the border as is shown at 52, for example. The support plate 50 is provided with a plurality of radial bores 54 which are upwardly connected to axially parallel bores 56 with junctions 58, 60 which are joined to two junctions 62, 64 via flexible lines. The junctions 62, 64 are mounted on a sleeve 66 which is accommodated in a bore in the collar 16 and has a central channel 68 which is connected to respective bores in the spindle. A vacuum, a gas pressure or even water may be optionally passed through these channels. The cross-bores 54 are joined to nozzle-like bores 62*a* in the support plate 50 which lead to the lower planar area of the support plate 50. The bores 62*a* are disposed according to a predetermined pattern and serve for retaining a wafer on the plate 50 by means of a vacuum. A polishing cloth 64*a* which has holes according to the same pattern as that of the support plate 50 is fixed below the support plate 50 by means of a backing film.

The support plate 50, via a cardan joint 70 which is not shown in detail, is coupled to a cylindrical component 72 which, in turn, is axially guided in a casing 74 by means of a ball-type guide which cannot be seen. The casing 74 is located in the collar 16 of the carrier portion 14, which fact is not described in detail. This axially guides the support plate 50 in a precise way if displaced by a gaseous medium and the plate may be easily tilted to all directions.

Figure 3:
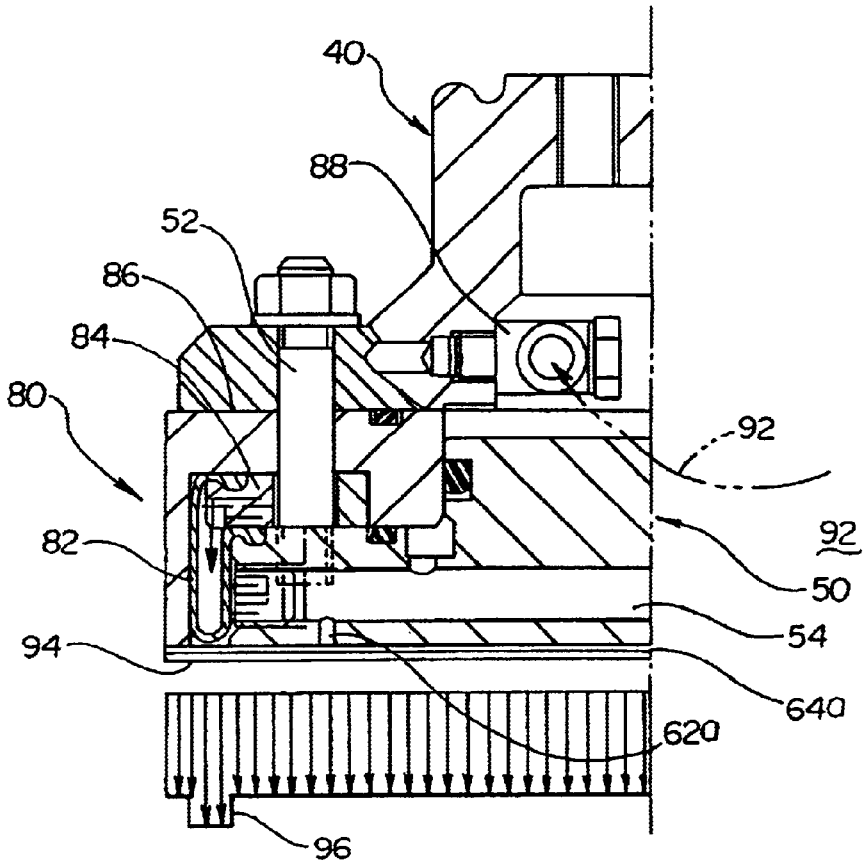
FIG. 3 shows a detail of FIG. 1 at a larger scale.
Figure 4:
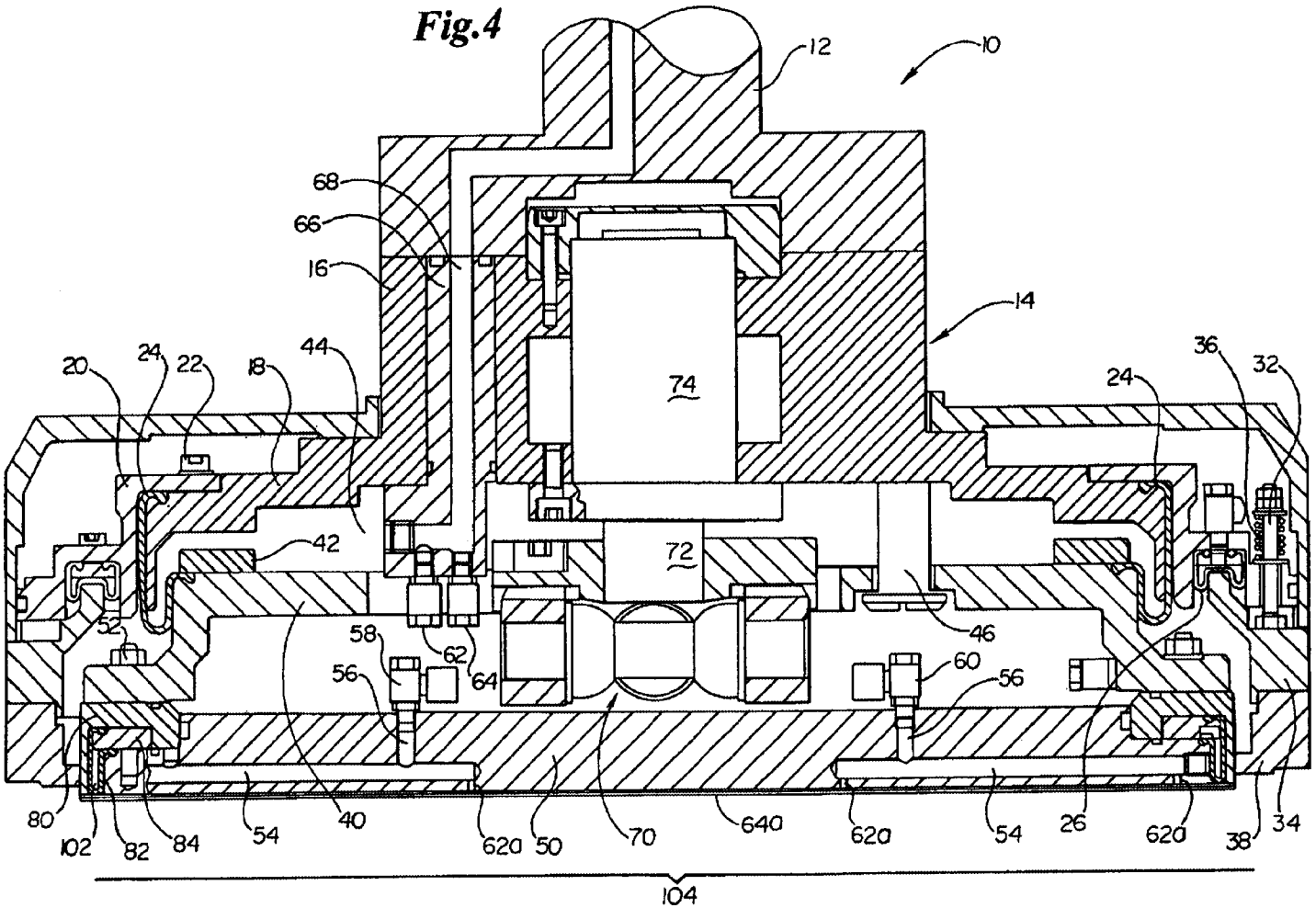
FIG. 4 shows an enlarged and simplified view of FIG. 1.

FIG. 4 is an enlarged and simplified view of FIG. 1. FIG. 4 also shows the ring-shaped recess 102 (discussed below in connection with FIG. 3). FIG. 4 also shows a polishing disk 104 which is used to polish wafer 94 held to the underside of support plate 50 by the vacuum source.

The components described and their functions have generally become known already from DE 197 55 975 A1 which was repeatedly mentioned. A particular feature ensues from FIG. 3.

It is apparent from FIG. 3 that the circumference of the support plate 50 has mounted, in a recess thereof, a ring-shaped component 80 which is fixedly connected to the support plate 50 by means of bolts such as the bolt 52. The ring-shaped component 80 has a ring-shaped recess 102 which faces downwards and which receives a ring-shaped circumferential membrane 82 or a ring-shaped circumferential hose of an elongate cross-section with the largest extension being parallel to the axis of the holder 10. The ends of the membrane are located in the recess by means of a ring 84 which is pinched between the ring-shaped component 80 and the respective part of the support plate 50. The inner space of the membrane 82 is in communication, via a line 86, with a proportional control valve 92. An appropriate pressure in the membrane 82 causes the membrane to expand downwardly, thus exerting a pressure on the polishing cloth 64*a* and, hence, on a wafer which is shown at 94 in FIG. 3. Since the material of the membrane 82 is resilient it will automatically be restored once the space in the membrane 82 is relieved from pressure. The membrane is designed so as not to project beyond the underside of the support plate 50 when in a state relieved from pressure.

FIG. 3 also illustrates the pressure distribution which can be applied to the wafer 94 by means of the support plate 50. It can be seen that the pressure is evenly distributed outside the area of the membrane 82. However, there is a pressure intensification at 96 in the area of the membrane 82. This compensates the smaller removal of material which is encountered close to the border of the wafer or the support plate 50.

Figure 2:
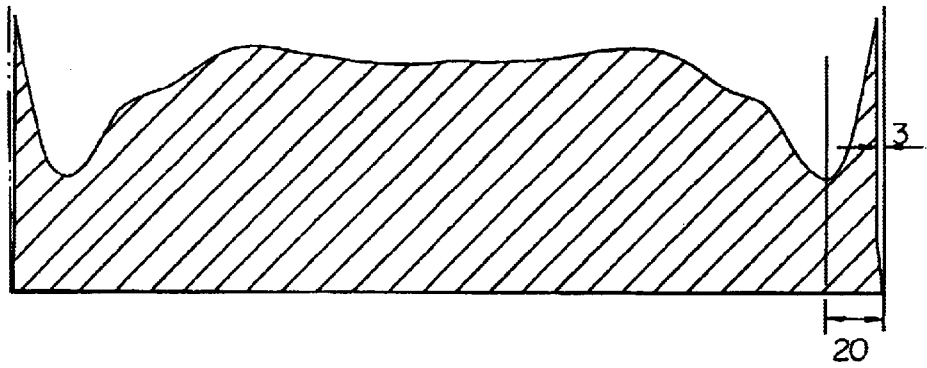
FIG. 2 shows a graph of the remaining thickness of a wafer layer which has been polished by means of a holder of FIG. 1.

Such a pressure distribution ensues from the graph of FIG. 2. As is apparent the wafer border undergoes more intense polishing while the least removal of material is achieved at a distance from the wafer border, e.g. 3 mm, and the largest removal of material is attained at a distance of 20 mm. Therefore, a differing removal of material is still achieved by means of the tool in FIG. 2. Nevertheless, a significant improvement is attained over the previous operations using conventional tools.

It is understood that the junction 88 needs to be joined to a respective connection on the carrier component 14 via an appropriate line in the space between the bell-shaped portion 40 and the support plate 50 in order that an appropriate pressure may be set up in the membrane 82 as was described.

The holder 10 which is shown operates as follows. A lowering motion onto a wafer, which is provided, by means of the spindle 12 which is adjustable in height causes the underside of the retaining plate 34 or the polishing cloth 64*a* to get into engagement with the wafer surface facing it. Prior to it, the support plate 50 was shifted to the position raised to a maximum with respect to the carrier component 14 by applying a vacuum to the chamber 44. Shortly before or during the contact with the wafer, the vacuum source applies a vacuum to the bores 62*a* in the way described. This holds the wafer on the support plate 50 and the wafer may now be moved to a working surface, e.g. a polishing disk. Above the polishing disk, the holder 10 is lowered up to a predetermined position in which the wafer is at a minimum distance from the polishing cloth of the polishing disk, but does not contact it yet. Subsequently, pressure is applied to the chamber 44, which action causes the support plate 50 to move downwards and to bring the wafer into engagement with the polishing disk. The force of engagement (the polishing force) is determined by the pressure in the chamber 44. Subsequently, the head or holder 10 are caused to rotate and the polishing operation starts. The vacuum is maintained at the bores 62*a* during the polishing process. Moreover, a predetermined pressure is set up in the membrane 82 via the proportional control valve 92, which membrane provides for an additional contact force in the area of the membrane 82 as can be seen with reference to FIG. 3. This equalizes the removal of material over the entire area of the wafer.

Once the polishing operation is completed a vacuum is applied to the chamber 44 again and the membrane 82 is relieved from load. The support plate 50 is slightly raised. The spindle 12 is moved up at the same time. The driving mechanism is moved to another position to deposit the wafer in another place. To this effect, the spindle is lowered in the new place and the wafer is released from the retaining plate 50 if the vacuum is removed from the bores 62*a* and a short shock or the like is applied. It is also possible to convey water to the underside of the retaining plate through the bores 62*a* in order to effect cleaning.

Finally, it is to be noted that a protective hood 100 is mounted at the upper surface of the flange 18 and protects the interior of the holder 10. It is not needed for the operation of the retaining head 10.

The above Examples and disclosure are intended to be illustrative and not exhaustive. These examples and description will suggest many variations and alternatives to one of the ordinary skill in this art. All these alternatives and variations are intended to be included within the scope of the attached claims.

Those familiar with the art may recognize other equivalents to the specific embodiments described herein which equivalents are also intended to be encompassed by the claims attached hereto.

What is claimed is:

1. A carrier for flat workpieces to be polished by a polishing apparatus, the polishing apparatus including at least one polishing disk, the carrier comprising:

a flange connected to a spindle, the spindle being operable to be rotated, lifted and lowered;

a support plate is coupled to the flange with a universal joint, whereby the support plate may linearly move and tilt relative to the flange, the support plate having a plurality of vertical bores therethrough which extend to the under side thereof, the plurality of vertical bores being connected to a vacuum source;

a membrane between the flange and the support plate to define a hollow spaces, the hollow space connected to a fluid source under pressure for varying the pressure in the hollow space;

a ring-shaped circumferential membrane supported by a radially outer portion of the support plate and a proportional control valve is connected to the ring-shaped circumferential membrane so that a displacement of the ring-shaped circumferential membrane is achieved; and the support plate and the ring-shaped circumferential membrane being structured such that a workpiece to be polished is engaged by the lower side of the support plate and of the ring-shaped circumferential membrane and carried by the support plate through a vacuum created in the plurality of vertical bores in the support plate by the vacuum source and can be pressed from above against the polishing disk in that the fluid pressure in the hollow space exerts a pressure onto the support plate and the ring-shaped circumferential membrane is displaced using the proportional control valve towards the polishing disk.

2. The carrier according to claim 1, characterized in that restoring means are provided which displace the ring-shaped circumferential membrane in a direction away from the underside of the support plate if the fluid pressure in the hollow space is decreased.

3. The carrier according to claim 1, characterized in that the ring-shaped circumferential membrane is made of an elastic material which is disposed in a ring-shaped recess of the support plate.

4. The carrier according to claim 3, characterized in that the membrane has an oblong cross-section with the major extension being in parallel with the axis of the spindle.

5. The carrier according to claim 3, characterized in that a fluid source is connected to the ring-shaped circumferential membrane via the proportional control valve.

6. The carrier according to claim 1, characterized in that the ring-shaped circumferential membrane acts on a polishing cloth which is adhered to the underside of the support plate.

* * * * *